US006116681A

United States Patent [19]

Borglum

[11] Patent Number: 6,116,681

[45] Date of Patent: Sep. 12, 2000

[54] PICNIC TABLE WHICH ACCOMMODATES INDIVIDUALS CONFINED TO WHEELCHAIRS

[76] Inventor: Keith Borglum, 218 Loma St., Waterloo, Iowa 50701

[21] Appl. No.: 08/871,919

[22] Filed: Jun. 10, 1997

[51] Int. Cl.[7] ..... A47B 39/00

[52] U.S. Cl. ..... 297/158.3; 297/157.1

[58] Field of Search ..... 297/157.1, 158.3, 297/159.1, 158.4, 158.5; 108/132, 115; D6/337, 338

[56] References Cited

U.S. PATENT DOCUMENTS

| | | | |
|---|---|---|---|
| D. 190,744 | 6/1961 | Guice . | |
| 1,417,891 | 5/1922 | Dudley . | |
| 2,399,378 | 4/1946 | Paquette . | |
| 3,120,405 | 2/1964 | Soszynski . | |
| 4,216,993 | 8/1980 | Shumaker . | |
| 4,223,945 | 9/1980 | Nikitits | 297/158.4 |
| 4,522,443 | 6/1985 | Van Blankenburg . | |
| 4,607,880 | 8/1986 | Gastebled . | |
| 4,700,986 | 10/1987 | Davis et al. . | |
| 4,917,436 | 4/1990 | Thom . | |
| 5,330,247 | 7/1994 | Fricke . | |
| 5,785,379 | 7/1998 | Pelletier | 297/158.5 |

*Primary Examiner*—Anthony D. Barfield
*Attorney, Agent, or Firm*—Andrus, Sceales, Starke & Sawall

[57] ABSTRACT

A picnic table is provided which includes a generally flat, horizontal table top and first and second pairs of leg support members for supporting the table top above a supporting surface. Each leg support member is generally J-shaped and has a first end mounted to the underside of the table top, and a second end mounted to the underside of a seat by a mounting assembly which supports each seat and braces the seat against a corresponding leg support member. First and second seats are mounted on a single side of the picnic table in a spaced relation so as to allow an individual confined to a wheelchair access to the table top of the picnic table therebetween. The table top defines an overhanging end portion which extends beyond one of the pairs of leg support members a distance sufficient to enable a wheelchair to be disposed therebelow, and a brace member is interconnected between the overhanging portion of the table top and the pair of leg support members for supporting the overhanging portion of the table top. The brace member includes a bend so as to provide unobstructed access for a wheelchair below the overhanging portion of the table top. An anti-tip member extends from a leg of the table to prevent the tipping of the overhanging portion of the table top when a load is placed thereon.

37 Claims, 2 Drawing Sheets

FIG. 3
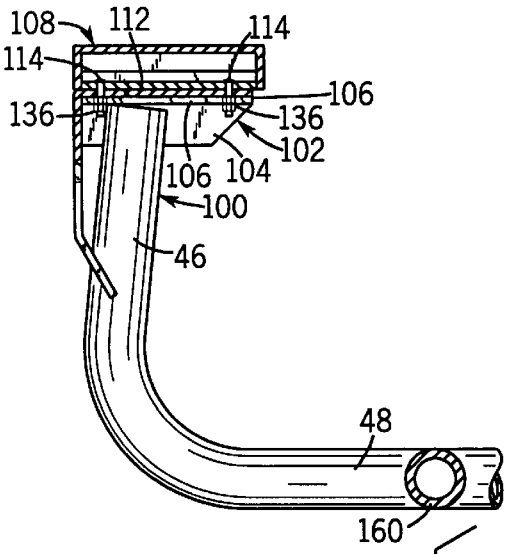
FIG. 4
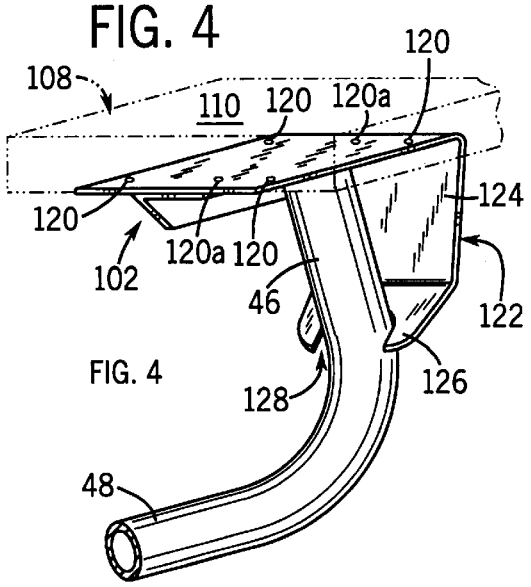
FIG. 4
FIG. 6
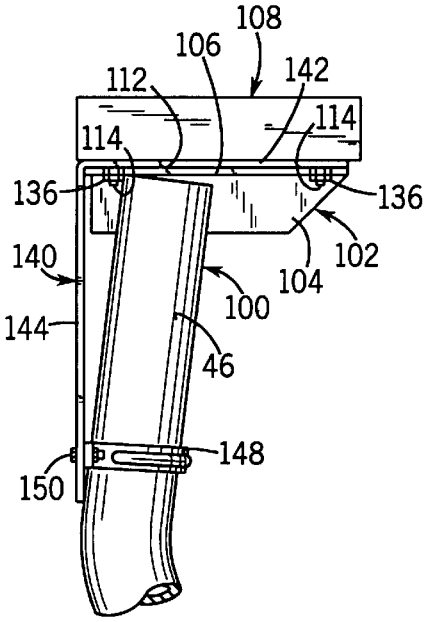
FIG. 5
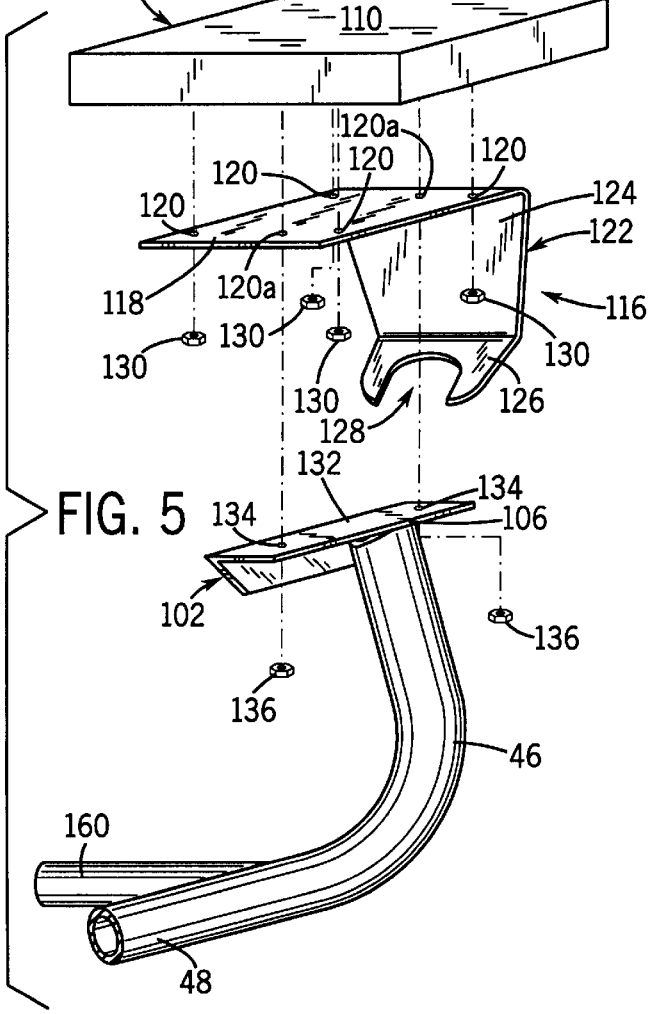

PICNIC TABLE WHICH ACCOMMODATES INDIVIDUALS CONFINED TO WHEELCHAIRS

BACKGROUND AND SUMMARY OF THE INVENTION

This invention relates to tables, and in particular, to picnic tables which accommodate users confined to a wheelchair.

Picnic tables typically include a table top, two benches, and a support structure for interconnecting the benches to the table top at a proper position and for supporting the benches and the table top above a supporting surface. While adequate for users without physical disabilities, prior art picnic tables are difficult, if not impossible, to use by individuals confined to a wheelchair.

Since most picnic tables have benches on either side of the table top for users to sit on, the benches provide an impediment for a user in a wheelchair to gain access to the table top of the picnic table. Specifically, the forward end of the wheelchair engages the bench and prevents the user from becoming sufficiently close to the table top of the picnic table to utilize it.

Furthermore, the legs used to support the picnic table extend downwardly from the table top at a location adjacent the ends of the picnic table. Similar to the benches, the legs of prior art picnic tables provide an impediment to the user of a wheelchair to be sufficiently close to the picnic table to utilize the table top. Oftentimes, the forward end of the wheelchair will engage the legs as the wheelchair is brought toward the end of the picnic table, thereby keeping the individual in the wheelchair away from the table top of the picnic table.

Therefore, it is a primary object and feature of the present invention to provide a picnic table wherein the table top is accessible by an individual confined to a wheelchair.

It is a further object and feature of the present invention to provide a picnic table which allows access to the table top by individuals confined in wheelchairs from one or both sides of the picnic table and from one or both ends of the same.

It is a further object and feature of the present invention to provide a picnic table wherein individual seats may be interconnected on a single side of the picnic table.

It is a still further object and feature of the present invention to provide a picnic table wherein a seat may be mounted on an individual support leg.

In accordance with the present invention, a picnic table includes a generally flat, horizontal table top having an upper surface and a second, opposite lower surface. The table top is defined by first and second ends, and first and second sides. First and second pairs of leg support members support the table top above a supporting surface. Each leg support member is generally J-shaped and has a first end mounted to the lower surface of the table top. The second ends of the first pair of leg support members are vertically and laterally displaced from a first side of the table top, and the second ends of the second pair of leg support members and vertically and laterally displaced from the second side of the table top.

First and second seat members are mounted to the second end of each leg support member of the first pair of leg support members. The first and second seat members are axially spaced so as to define a wheelchair receipt passage therebetween. A bench member is mounted to and supported by the second end of each leg support member of the second pair of leg support members.

A bracket is mounted to the end of each leg support member to facilitate interconnecting a corresponding seat member or bench member thereto. Each bracket includes a generally horizontal seat supporting arm. A mounting assembly is provided for interconnecting a corresponding seat member or bench member to the seat supporting arm of a corresponding bracket. Each mounting assembly includes a generally horizontal arm positioned between the seat supporting arm of a corresponding bracket and a corresponding seat member or bench member. The mounting assembly further includes a bracing arm extending from the horizontal arm. The bracing arm has a first end adjacent to the corresponding leg support member so as to discourage tilting of the corresponding seat member or bench member. In the first embodiment, the bracing arm of each mounting assembly includes a cut out therein so as to receive a first end of the corresponding leg support member therethrough. In the alternative, a strap is utilized to interconnect the bracing arm to a corresponding leg support member so as to prevent tilting of the seat member or bench member mounted thereto.

BRIEF DESCRIPTION OF THE DRAWINGS

The drawings furnished herewith illustrate the best mode of the present invention in which the above advantages and features are clearly disclosed as well as others which will be readily understood from the following description of the illustrated embodiment.

In the drawings:

FIG. 3 is a partial cross-sectional view of the picnic table of FIG. 2 taken along line 3—3;

FIG. 4 is an enlarged, isometric view showing an individual seat of the picnic table of the present invention;

FIG. 5 is an exploded, isometric view showing the individual seat of FIG. 4; and FIG. 6 is an enlarged, end view, partially in section, showing an alternate mounting assembly for mounting an individual seat to the picnic table of the present invention.

DETAILED DESCRIPTION OF THE DRAWINGS

Figure 1:
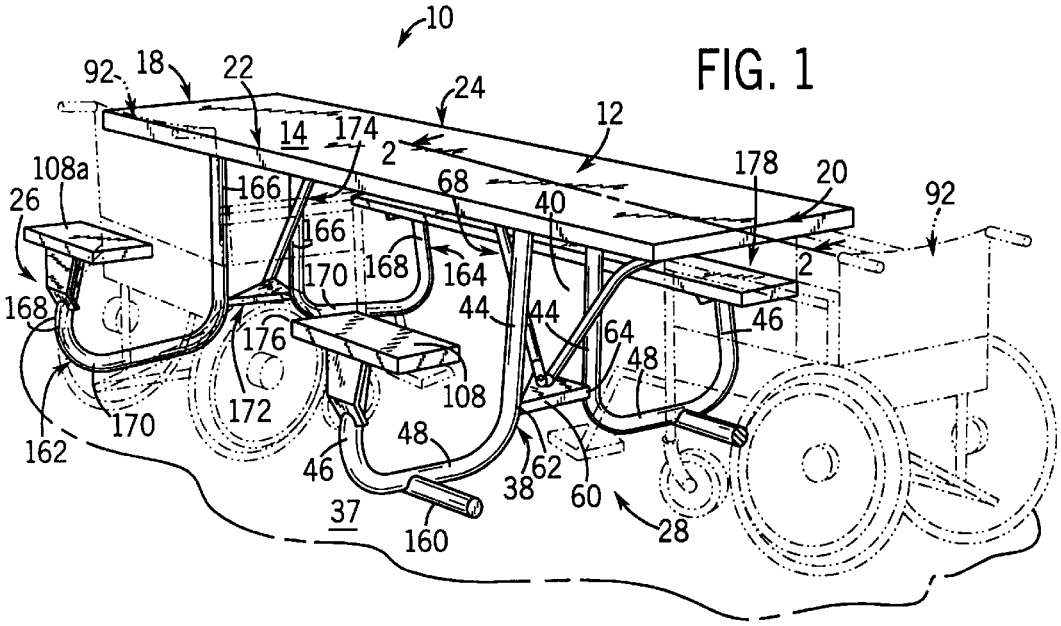
FIG. 1 is an isometric view of a picnic table in accordance with the present invention.

Referring to FIG. 1, a picnic table corresponding to the present invention is generally designated by the reference numeral 10. The picnic table 10 includes a table top 12 having an upper surface 14 and a lower surface 16, FIG. 2. Table top 12 extends along a longitudinal axis and further includes first 18 and second 20 ends which define a predetermined length for table top 12, and first 22 and second 24 sides which define a predetermined width for table top 12.

An end member 21 depends from each end 18 and 20 of table top 12. Similarly, a side member 25 depends from each side 22 and 24 of table top 12. End members 21 and side members 25 form a continuous, generally rectangular frame which extends about the outer periphery of table top 12.

Figure 2:
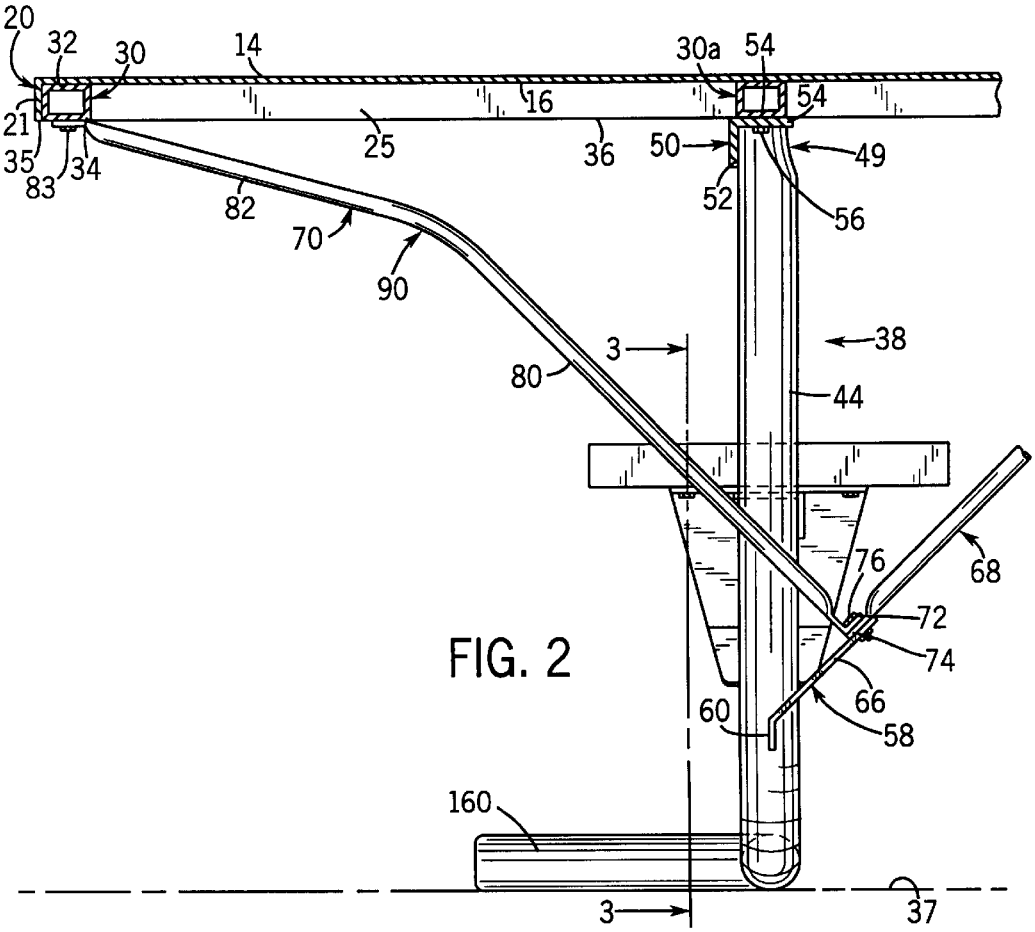
FIG. 2 is a partial cross-sectional view of the picnic table of FIG. 1 taken along line 2—2.

Referring to FIG. 2, table top 12 further includes a plurality of strengthening members such as tubes 30 and 30*a* which are mounted to the lower surface 16 of table top 12 transverse to its longitudinal axis so as to add rigidity thereto. Strengthening tubes 30 and 30*a* are identical in structure and have a generally rectangular cross section. Each strengthening tube 30 and 30*a* includes a first upper sidewall 32 mounted to the lower surface 16 of table top 12, and a second, lower sidewall 34 lying in a common plane with edges 35 of end members 21 of table top 12 and edges 36 of side members 25.

As best seen in FIG. 2, a strengthening tube 30 is mounted adjacent to a corresponding end member 21 to add stability to end 20 of table top 12. It is contemplated that an additional strengthening tube 30 be mounted adjacent end member 21 of end 18 so as to add stability to end 18 of table top 12. Strengthening tubes 30*a* are mounted to the lower surface 16 of table top 12 at locations parallel to and axially spaced from strengthening tubes 30, for reasons hereinafter described.

Picnic table 10 further includes first 26 and second 28 pair of leg structures which are interconnected to a corresponding strengthening tube 30*a* mounted to the lower surface 16 of table top 12 in order to support table top 12 above a support surface 37, such as a floor, the ground or the like. As best seen in FIG. 1, second leg structure pair 28 includes first 38 and second 40 generally J-shaped legs which are identical in structure. Each leg 38 and 40 includes a vertically extending table supporting portion 44, and a vertically extending seat supporting portion 46. The table supporting portion 44 and seat supporting portion 46 are interconnected by a horizontal support surface engaging portion 48 which is transverse to the longitudinal axis of table top 12. In a preferred embodiment, table supporting portion 44, support surface engaging portion 48, and seat supporting portion 46 are formed as an integral member by bending a length of tubular metal stock, in a manner as is known.

As hereinafter described, legs 38 and 40 are mounted to strengthening tube 30*a* in an identical manner and as such, the mounting of leg 38 to strengthening tube 30*a* will be described in detail with the description being understood to also describe the mounting of leg 40 to strengthening tube 30*a*.

As best seen in FIG. 2, an upper end 49 of leg 38 terminates at a generally L-shaped leg mounting bracket 50. A first arm 52 of leg mounting bracket 50 is secured to upper end 49 of leg 38 such as by welding, while a second arm 54 of leg mounting bracket 50 is also welded to leg upper end 49 and is mounted to the lower sidewall 34 of strengthening tube 30*a* by a bolt 56 or the like. In such a manner, leg 38 is interconnected to strengthening tube 30*a* and hence, to the lower surface 16 of table top 12.

Legs 38 and 40 of second leg structure pair 28 lie in a common plane and are interconnected toward the lower ends by a leg connecting bracket 58. Leg connecting bracket 58 includes a first arm 60 which lies in a plane perpendicular to table top 12 and extends between the vertically extending table supporting portion 44 of each leg 38 and 40. First arm 60 has a first end 62 interconnected to leg 38 and a second end 64 interconnected to the leg 40 so as to stabilize legs 38 and 40 and discourage the movement of legs 38 and 40 away from each other. The interconnection of ends 62 and 64 with legs 38 and 40, respectively, may be made in any satisfactory manner, such as by welding.

A second, generally triangular arm 66 of leg connecting bracket 58 extends from first arm 60 and projects at an angle toward first leg structure pair 26 and toward lower surface 16 of table top 12. A first brace 68 extends between second arm 66 of leg connecting bracket 58 and a strengthening tube 30*a* located between leg structure pairs 26 and 28, lower surface 16 of table top 12, and a second brace 70 extends between the second arm 66 of bracket 58 and the lower side wall 34 of the strengthening tube 30 positioned adjacent end 20 of table top 12. Second brace 70 includes an L-shaped end 72 which, along with end 74 of brace 68, is mounted to second arm 66 of bracket 58 by a bolt or other fastener 76.

Second brace 70 further includes a lower portion 80 which is perpendicular to first brace 68, and an upper portion 82 which is interconnected to lower side wall 34 of strengthening tube 30 by a bolt 83. A bend 90 is formed at the intersection of lower 80 and upper 82 portions of second brace 70 in order to increase the vertical distance between upper portion 82 of second brace 70 and support surface 37. As best seen in FIG. 1, this increased vertical distance allows a standard size wheelchair 92 to be partially received under end 20 of table top 12, thereby allowing a user confined to a wheelchair access to the table top 12 of picnic table 10.

As best seen in FIGS. 3–5, the seat supporting portion 46 of each leg 38 and 40 terminates at a generally L-shaped seat supporting bracket 102. The first arm 104 of each seat supporting bracket 102 is secured to the upper end of seat supporting portion 46, such as by welding, bolting, fastening or the like. A second arm 106 of seat supporting bracket 102 may support a seat member 108 or alternatively, a bench member 109, FIG. 1.

Seat member 108 includes an upper, seating surface 110 and an underside 112 interconnected by a series of side walls. A series of mounting bolts 114 depend from the underside 112 of seat member 108. A seat supporting arm 118 of a mounting bracket 116 includes a series of apertures 120 and 120*a* which are aligned with mounting bolts 114 depending from the underside 112 of seat 108.

Mounting bracket 116 also includes a bracing arm 122 having a generally flat shielding and bracing portion 124, and a leg engaging portion 126 which tapers from shielding and bracing portion 124. Leg engagement portion 126 of bracing arm 122 includes a concave cut out 128 which is adapted for receiving a corresponding vertically extending seat supporting portion 46 of leg 38 therethrough.

During assembly, apertures 120 and 120*a* in seat supporting arm 118 are aligned with corresponding mounting bolts 114 which depend from the underside 112 of seat member 108 such that mounting bolts 114 extend therethrough. Nuts 130 are threaded onto corresponding mounting bolts 114 which project through apertures 120 in seat supporting arm 118 so as to interconnect mounting bracket 116 to the underside 112 of seat member 108. Thereafter, mounting bracket 116 is positioned on the upper surface 132 of second arm 106 of seat supporting bracket 102 such that the mounting bolts 114 which extend through apertures 120*a* in seat supporting arm 118 of mounting bracket 116 also extend through corresponding apertures 134 in second arm 106 of seat supporting bracket 102, and such that end 100 of the vertically extending seat supporting portion 46 of leg 38 extends through cut out 128 in a corresponding mounting bracket 116. Nuts 136 are threaded onto corresponding mounting bolts 114 which project through apertures 134 in seat supporting bracket 102. By capturing seat supporting arm 118 of mounting bracket 116 between second arm 106 of seat supporting bracket 102 and the underside 112 of seat member 108, seat member 108 is interconnected to the corresponding end 100 of leg 38.

With vertically extending seat supporting portion 46 of leg 38 extending through cut out 128 of bracing arm 122, the leg engagement portion 126 of bracing arm 122 partially surrounds the vertically extending seat supporting portion 46 of leg 38. In use, if an individual is seated on the seating surface 110 of seat member 108, leg engagement portion 126 of mounting bracket 116 prevents the tilting of seat 108 so as to provide a stable seating surface 110 for an individual.

Referring to FIG. 6, an alternate mounting bracket 140 is shown for interconnecting seat member 108 to the upper end 100 of leg 38. Mounting bracket 140 is generally L-shaped and includes a first horizontal arm 142 which is identical in structure to seat supporting arm 118 of mounting bracket 116. Mounting bracket 140 further includes a second arm 144 which is perpendicular to first arm 142. In order to mount seat member 108 to end 100 of leg 38, first arm 142 is mounted to the underside 112 of seat member 108 and captured between second 106 of seat supporting bracket 102 and the underside 112 of seat member 108 in the same manner as described with respect to the mounting of seat member 108 to end 100 of leg 38 with mounting bracket 114. In addition, a strap 148 is positioned around the vertically extending seat supporting portion 46 of leg 38 and secured to second arm 144 of mounting bracket 140 by fastener 150 so as to interconnect mounting bracket 140 to vertically extending seat portion 46 of leg 38.

As described, with strap 148 interconnecting vertically extending seat portion 46 of leg 38 and second arm 144 of mounting bracket 140, second arm 144 acts as a brace so as to prevent tilting of seat member 108 when an individual is seated on seating surface 110. As seen in FIG. 6, second arm 144 acts to support and brace the underside 112 of seat 108 against vertically extending seat supporting portion 46 of leg 38.

Each leg 38 and 40 includes an anti-tipping foot 160 which projects laterally from the support surface engaging portion 48 along an axis parallel to the longitudinal axis of table top 12 and in a direction toward end 20 of table top 12. Since legs 38 and 40 are axially spaced from end 20 of table top 12 so as to allow wheelchair 92 to be partially received under end 20 of table top 12, anti-tipping feet 160 prevent the tipping of table top 12 by the clockwise rotation of end 20 when a load is placed on end 20. The axial length of anti-tipping feet 160 is dependent upon the axial spacing between strengthening tube 30*a* and end 20 of table top 12.

First leg structure pair 26 is also interconnected to a corresponding strengthening tube 30*a* on the lower surface 16 of table top 12 adjacent table end 18. Referring to FIG. 1, first leg structure pair 26 includes first 162 and second 164 generally J-shaped legs which are identical in structure. Each leg 162 and 164 includes a vertically extending table supporting portion 166 and a vertically extending seat support portion 168. The table supporting portion 166 and the seat supporting portion 168 are interconnected by a horizontal support surface engaging portion 170 which is transverse to the longitudinal axis of table top 12 as with legs 38 and 40, table supporting portion 166, support surface engaging portion 170, and seat supporting portion 168 of legs 162 and 164 are formed as an integral member by bending a length of tubular metal stock, in a manner as is known.

A bracket member 172 extends between and interconnects table supporting portions 166, and is constructed similarly to mounting bracket 60. A brace member 174, which is substantially identical to brace member 68, extends between and interconnects bracket member 172 and one of strengthening tubes 30*a*.

Legs 162 and 164 are interconnected to a strengthening tube 30*a* and hence, to the lower surface 16 of table top 12, in the same manner as legs 38 and 40 are interconnected to table top 12 and as such, the description for interconnecting legs 38 and 40 to lower surface 16 of table top 12 is understood to describe the structure and manner for interconnecting legs 162 and 164 to the lower surface 16 of table top 12. Similarly, the description of the arrangement and structure for mounting seat member 108 to upper end 100 of leg 38 is understood to describe the structure and manner for mounting a seat member 108*a* to the upper end of leg 162.

As best seen in FIG. 1, seat members 108 and 108*a*, which are mounted to legs 38 and 162, respectively, are axially spaced and define a wheelchair receipt passage 176 is therebetween. Wheelchair receipt passage 176 is of sufficient width so as to accommodate a standard wheelchair 92 therein, thereby allowing a user confined to wheelchair 92 access to table top 12 of picnic table 10.

With respect to legs 40 and 164, a bench member 178 may be supported by and interconnected to the seat supporting portions 46 and 168 of legs 40 and 164, respectively, so as to provide a sitting surface for users of picnic table 10. In the alternative, individual seat members such as 108 or 108*a* may be mounted on corresponding second ends of legs 40 and 164, in a manner heretofore described with respect to the mounting of seat member 108 on leg 38.

Various modes of carrying out the invention are contemplated as being within the scope of the following claims particularly pointing out and distinctly claiming the subject matter which is regarded as the invention.

I claim:

1. A table, comprising:

a generally flat, horizontal table top having an upper surface and an opposite lower surface, the table top defined by first and second ends and first and second sides;

first and second pairs of leg support members for supporting the table top above a supporting surface, wherein the first pair and the second pair of leg support members are laterally displaced one from each side of the table top;

first and second seat members, each seat member being mounted to a leg support member of one of the first and second pairs of leg support members outwardly of the first side of the table top, wherein the seat members are aligned with each other and axially spaced from each other so as to define a wheelchair receipt passage therebetween on the first side of the table top; and a bench member, wherein the bench member is mounted to one of the pairs of leg support members outwardly of the second side of the table top.

2. The table of claim 1 wherein each leg support member includes a generally vertical table supporting portion, a generally vertical seat supporting portion, and a support surface engaging portion therebetween, the support surface engaging portion being engageable with a supporting surface.

3. The table of claim 2 wherein the support surface engaging portion of each leg support member includes an anti-tipping member projecting laterally therefrom.

4. The table of claim 1 further comprising a connection member for interconnecting a first leg support member and a second leg support member of the first pair of leg support members.

5. The table of claim 4 further comprising a second connection member for interconnecting a first leg support member and a second leg support member of the second pair of leg support members.

6. The table of claim 4 further comprising a bracing member extending between the connection member and the lower surface of the table top.

7. The table of claim 1 further comprising a plurality of strengthening tubes mounted to the lower surface of the table top.

8. The table of claim 7 wherein each strengthening tube extends from the first to the second side of the table top.

9. The table of claim 7 wherein each strengthening tube has a generally rectangular cross section.

10. The table of claim 7 wherein one of the plurality of strengthening tubes is mounted to the lower surface of the table top at a location adjacent the first end of the table top, and wherein a second of the plurality of strengthening tubes is mounted to the lower surface of the table top at a location adjacent the second end of the table top.

11. The table of claim 1 wherein each of the first and second seat member is mounted to its respective leg support member via a bracket mounted to the leg support member, wherein the bracket defines a generally horizontal seat supporting arm.

12. The table of claim 11 further comprising a mounting assembly interconnecting the seat supporting arm of the bracket to one of the seat members.

13. A table, comprising:

a generally flat, horizontal table top having an upper surface and an opposite lower surface, the table top defined by first and second ends and first and second sides;

first and second pairs of leg support members for supporting the table top above a supporting surface, wherein the first pair and the second pair of leg support members are laterally displaced one from each of the table top;

first and second seat members, each seat member being mounted to a leg support member of one of the first and second pairs of leg support members outwardly of the first side of the table top, wherein the seat members are aligned with each other and axially spaced from each other so as to define a wheelchair receipt passage therebetween on the first side of the table top;

a connection member for interconnecting a first leg support member and a second leg support member of the first pair of leg support members; and a bracing member extending between the connection member and the lower surface of the table top;

wherein the bracing member extends from the connection member toward the first end of the table top and is interconnected with the table top adjacent the first end, wherein the bracing member is configured so as to provide clearance for a wheelchair between the bracing member and a support surface.

14. The table of claim 13 further comprising a second bracing member extending from the connection member in a direction opposite that of the first-mentioned bracing member and interconnected with the table top.

15. A table, comprising:

a generally flat, horizontal table top having an upper surface and a second, opposite lower surface, the table top defined by first and second ends and first and second sides;

first and second pairs of leg support members for supporting the table top above a supporting surface, wherein the first pair and the second pair of leg support members are laterally displaced from both the first and second sides of the table top; and first and second seat members each seat member being mounted to one of the leg support members of the first and second pairs of leg support members outwardly of the first side of the table top, wherein the seat members are aligned with each other and axially spaced from each other so as to define a wheelchair receipt passage therebetween on the first side of the table top;

a bracket mounted to the second end of one of the leg support members, and having a generally horizontal seat supporting arm; and a mounting assembly interconnecting the seat supporting arm of the bracket to a seat member;

wherein the mounting assembly includes a generally horizontal arm positioned between the seat supporting arm of the bracket and the seat member, and further includes a bracing arm extending from the horizontal arm, the bracing arm having a first end adjacent to the leg support member so as to discourage tilting of the seat member.

16. The table of claim 15 wherein the first end of the bracing arm of the mounting assembly includes a cut out therein such that the first end of the bracing arm partially surrounds the leg support member.

17. The table of claim 15 wherein the bracing arm of the mounting assembly is interconnected to a leg support member by a strap.

18. A table, comprising:

a generally flat, horizontal table top extending along a longitudinal axis and having an upper surface and a second, opposite lower surface, the table top defined by first and second ends and first and second sides;

first and second pairs of leg support members for supporting the table top above a support surface, each leg support member including an upwardly extending table supporting portion, an upwardly extending seat supporting portion, and a transverse portion therebetween adapted for engagement with a support surface, the table supporting portion of each leg support member being mounted to the table top, wherein the first pair of leg support members are spaced inwardly from the first end of the table top such that the table top defines an overhanging end portion extending outwardly of the first pair of leg support members;

an anti-tipping member projecting laterally from the transverse portion of each leg support member of the first pair of leg support members along an axis parallel to the longitudinal axis of the table top, wherein the anti-tipping members extend outwardly toward the first end of the table top and are located below the overhanging end portion of the table top; and seat structure mounted to the seat supporting portions of the leg support members, wherein the seat structure is vertically and laterally displaced from the sides of the table top.

19. The table of claim 18 wherein the first and second leg support members of the first pair of leg support members lie in a common plane such that the first and second leg support members are mounted to the lower surface of the table top at a predetermined axial distance from the first end of the table top.

20. The table of claim 19 further comprising a connection member for interconnecting the first and second leg support members of the first of leg support members.

21. The table of claim 20 further comprising a bracing element extending between the connection member and the lower surface of the table top.

22. The table of claim 18 further comprising first and second brackets, wherein each bracket is mounted to the seat supporting portion of one of the leg support members and has a generally horizontal seat supporting arm.

23. The table of claim 22 further comprising first and second mounting assemblies, each mounting assembly interconnecting the seat supporting arm of each bracket to one of the seat members.

24. A table, comprising:

a generally flat, horizontal table top extending along the longitudinal axis and having an upper surface and a second, opposite lower surface, the table top defined by first and second ends and first and second sides;

first and second pairs of leg support members for supporting the table top above a support surface, each leg support member including a generally vertical table supporting portion, a generally vertical seat supporting portion, and a support surface engaging portion therebetween, the vertical table supporting portion of each leg support member being mounted to the lower surface of the table top;

an anti-tipping member projecting laterally from the support engaging portion of one or more leg support members along an axis parallel to the longitudinal axis of the table top;

first and second brackets, each bracket mounted to the seat supporting portion of one of the leg support members and having a generally horizontal seat supporting arm; and first and second mounting assemblies, each mounting assembly interconnecting the seat supporting arm of each bracket to one of the seat members, wherein each mounting assembly includes a generally horizontal arm positioned between the seat supporting arm of a corresponding bracket and a corresponding seat member, and further includes a bracing arm extending from the horizontal arm, the bracing arm having a first end adjacent to the corresponding leg support member so as to discourage tilting of the corresponding seat member.

25. The table of claim 24 wherein a first end of each bracing arm partially surrounds the corresponding leg support member.

26. The table of claim 24 wherein the first end of each bracing arm is interconnected the corresponding leg support member by a strap.

27. A table, comprising:

a generally flat, horizontal table top having an upper surface and a second, opposite lower surface, the table top defined by first and second ends and first and second sides;

a plurality of leg support members for supporting the table top above a supporting surface, each leg support member being generally J-shaped and having a first end mounted to the lower surface of the table top, and a second end, wherein each leg support member is configured such that the second end of each leg support member is vertically and laterally displaced from one side of the table top;

first and second generally L-shaped brackets, each bracket having a first arm mounted to the second end of one of a pair of leg support members located on one side of the table top, and a second, generally horizontal seat supporting arm extending therefrom;

first and second mounting assemblies for interconnecting each bracket to a corresponding seat member, each mounting assembly including a generally horizontal arm positioned between the seat supporting arm of a corresponding bracket and a seat member to be mounted thereto, and further including a bracing arm extending from the horizontal arm, the bracing arm having a first end adjacent to the corresponding leg support member; and a bench member mounted to and supported by the second end of each leg support member located on the other side of the table top.

28. The table of claim 27 wherein the first end of the bracing arm includes a cut out therein such that the first end of the bracing arm partially surrounds the corresponding leg support member.

29. The table of claim 27 further comprising first and second straps, each strap interconnecting a corresponding bracing arm to a corresponding leg support member.

30. The table of claim 27 wherein first and second leg support members of a pair of leg support members lie in a common plane and are interconnected by a connection member.

31. The table of claim 30 further comprising a bracing element extending between the connection member and the lower surface of the table top.

32. In a table including a table top, one or more support members interconnected with the table top for supporting the table top above a supporting surface, wherein the table defines first and second spaced sides and first and second spaced ends, and further including first and second seat structures interconnected with the table top support members and disposed along the first and second sides, respectively, of the table top, the improvement comprising:

the first end of the table top defining an overhanging end portion located between the first and second seat structures, wherein the overhanging end portion extends outwardly beyond at least one of the support members in an amount sufficient to enable a wheelchair to be disposed therebelow; and an outwardly extending brace member interconnected between the support member and the overhanging end portion of the table top, wherein the brace member is located between the first and second seat structures and is configured so as to accommodate a wheelchair below the overhanging end portion of the table top and is interconnected with the overhanging end portion of the table top at a distance from the support member sufficient to provide support thereto.

33. In a table including a table top, one or more support members interconnected with the table top for supporting the table top above a supporting surface, wherein the table defines a pair of spaced sides and a pair of ends, and further including seat structure interconnected with the table top support members and disposed along at least one of the sides of the table top, the improvement comprising:

an end portion of the table top defining an overhanging end portion extending beyond at least one of the support members in an amount sufficient to enable a wheelchair to be disposed therebelow; and a brace member interconnected between the support member and the overhanging portion of the table top, wherein the brace member is configured so as to accommodate a wheelchair below the overhanging portion of the table top and is interconnected with the overhanging portion of the table top at a distance from the support member sufficient to provide support thereto, wherein the brace member defines a first end interconnected with the support member and a second end interconnected with the table top overhanging portion, and includes a bend therebetween providing sufficient clearance below the table top overhanging portion to enable placement of the wheelchair therebelow.

34. The improvement of claim 32 wherein the support member includes a pair of spaced apart leg members, each of which is interconnected with the table top, and a support bracket disposed between and interconnecting the leg members, wherein the first end of the brace member is interconnected with the support bracket.

35. A table, comprising:

a generally flat, horizontal table top having an upper surface and a second, opposite lower surface, the table top defined by first and second ends and first and second sides;

first and second pairs of leg support members for supporting the table top above a supporting surface, wherein the first pair and the second pair of leg support members are laterally displaced from both the first and second sides of the table top;

first and second seat members, each seat member being mounted to one of the leg support members of the first and second pairs of leg support members outwardly of the first side of the table top and being axially spaced so as to define a wheelchair receipt passage therebetween; and a bench member, the bench member mounted to one of the leg support members of the first and second pair of leg support members outwardly of the second side of the table top.

36. A table, comprising:

a generally flat, horizontal table top having an upper surface and a second, opposite lower surface, the table top defined by first and second ends and first and second sides;

first and second pairs of leg support members for supporting the table top above a supporting surface, wherein the first pair and the second pair of leg support members are laterally displaced from both the first and second sides of the table top;

first and second seat members, each seat member being mounted to one of the leg support members of the first and second pairs of leg support members outwardly of the first side of the table top, and being axially spaced so as to define a wheelchair receipt passage therebetween;

a connection member for interconnecting a first leg support member and a second leg support member of the first pair of leg support members; and a bracing member extending between the connection member and the lower surface of the table top, wherein the bracing member extends from the connection member toward the first end of the table top and is interconnected with the table top adjacent the first end, wherein the bracing member is configured so as to provide clearance for a wheelchair between the bracing member and a support surface.

37. A table, comprising:

a generally flat, horizontal table top having an upper surface and a second, opposite lower surface, the table top defined by first and second ends and first and second sides;

first and second pairs of leg support members for supporting the table top above a supporting surface, wherein the first pair and the second pair of leg support members are laterally displaced from both the first and second sides of the table top;

first and second seat members, each seat member being mounted to one of the leg support members of the first and second pairs of leg support members outwardly of the first side of the table top, and being axially spaced so as to define a wheelchair receipt passage therebetween;

a bracket mounted to one of the leg support members, and having a generally horizontal seat supporting arm; and a mounting assembly interconnecting the seat supporting arm of the bracket to one of the seat members, wherein the mounting assembly includes a generally horizontal arm positioned between the seat supporting arm of the bracket and the seat member, and further includes a bracing arm extending from the horizontal arm, the bracing arm having a first end adjacent to the leg support member so as to discourage tilting of the seat member.

* * * * *